United States Patent [19]

Liefer et al.

[11] Patent Number: 4,709,519

[45] Date of Patent: Dec. 1, 1987

[54] MODULAR FLOOR PANEL SYSTEM

[76] Inventors: Allen C. Liefer, R.R. 3, Box 362, Macon, Mo. 63552; Gilbert L. Loewen, 802 Walnut St.; Paul J. Magathan, 502 Maple St., both of Peabody, Kans. 66866

[21] Appl. No.: 514,161

[22] Filed: Jul. 15, 1983

Related U.S. Application Data

[63] Continuation-in-part of Ser. No. 471,860, Mar. 3, 1983, Pat. No. 4,557,086.

[51] Int. Cl.[4] ..... E04C 1/00

[52] U.S. Cl. ..... 52/98; 52/177; 52/263; 52/480; 29/413

[58] Field of Search ..... 52/98-100, 52/192, 194, 222, 245-248, 263, 457, 478, 480, 723, 302-305, 145, 384, 390, 177, 741; 29/413; 206/322

[56] References Cited

U.S. PATENT DOCUMENTS

| | | | |
|---|---|---|---|
| Re. 31,368 | 9/1983 | Trumper | 52/478 |
| 1,728,934 | 9/1929 | Hogenson | 206/322 |
| 1,862,227 | 6/1932 | Mahon | 52/478 |
| 1,863,257 | 6/1932 | Tashjian | 52/474 |
| 1,892,885 | 1/1933 | Grigsby | 52/386 |
| 2,083,725 | 6/1937 | Manske et al. | 52/489 |
| 2,106,084 | 1/1938 | Coddington | 52/98 |
| 2,439,853 | 4/1948 | Moffet, Jr. | 52/23 |
| 2,543,122 | 2/1951 | Mortensen | 52/588 |
| 2,565,292 | 8/1951 | Arthur | 52/69 |
| 2,901,960 | 9/1959 | Barre et al. | 52/198 |
| 3,008,256 | 11/1961 | Rice | 52/98 |
| 3,031,044 | 4/1962 | Stitt et al. | 52/588 |
| 3,067,843 | 12/1962 | Rushtoh et al. | 52/126.6 |
| 3,080,022 | 3/1963 | Mote | 52/588 |
| 3,206,898 | 9/1965 | Schroyer | 52/222 |
| 3,283,459 | 11/1966 | Beranek et al. | 52/263 |
| 3,336,705 | 8/1967 | Vecchiarelli et al. | 52/222 |
| 3,426,445 | 2/1969 | Steffen | 34/233 |
| 3,513,613 | 5/1970 | Jones et al. | 52/222 |
| 3,552,003 | 1/1971 | Argarwala | 29/846 |
| 3,724,078 | 4/1973 | Carlin et al. | 52/177 |
| 3,892,902 | 7/1975 | Ilukowicz | 52/98 |
| 4,073,110 | 2/1978 | Kennedy | 52/303 |

FOREIGN PATENT DOCUMENTS

| | | | |
|---|---|---|---|
| 568949 | 1/1959 | Canada | 52/145 |
| 7801496 | 1/1980 | Sweden | 52/478 |
| 2085863 | 5/1982 | United Kingdom | 52/192 |

OTHER PUBLICATIONS

S & H Manufacturing Inc., Nappanee, Indiana, "Channel-Lok Floors", Floor Support Systems (4 pages).

Bantam Systems Inc., Chicago, Il., "Bantams Super Floor", 2 pages, BSI 1-1-82.

Caldwell Manufacturing Co., Kearney, Nebraska, "Perforated-Corrugated Aeration Drying Floors", Advertising Bulletin 601, 1/1/77.

Keho Alta Products, Borans, Alberta Canada, "It's in the Bin with Keho".

*Primary Examiner*—John E. Murtagh

*Assistant Examiner*—Andrew Joseph Rudy

*Attorney, Agent, or Firm*—Neuman, Williams, Anderson & Olson

[57] ABSTRACT

A floor panel system for use in grain storage and drying bins is disclosed which uses modular perforated floor panels each of which is hemmed across the width of the panel at predetermined points along its length so that panels of various lengths can be provided readily by breaking standard panels along any appropriate selected hem. The hems also reinforce the panels. Each modular floor panel may have a complete hem at one end and a half hem or flange at the other end such that the panels can be readily aligned and interlocked end-to-end by inserting the half hem or flange of one panel into the full hem of a succeeding panel. A transverse clip may be used to hold together two abutted modular floor panels end-to-end and for reinforcing purposes where high floor loads are contemplated. Adjacent panels are abutted together along the sides and are held together by fitting the side lips into rails or support beams. These rails in turn are resiliently gripped in notches cut into the top edges of the side walls of V-shaped posts. The beam can be fit into these posts and resiliently held by the legs of the post, as when the post is squeezed and then released.

17 Claims, 12 Drawing Figures

FIG. 1
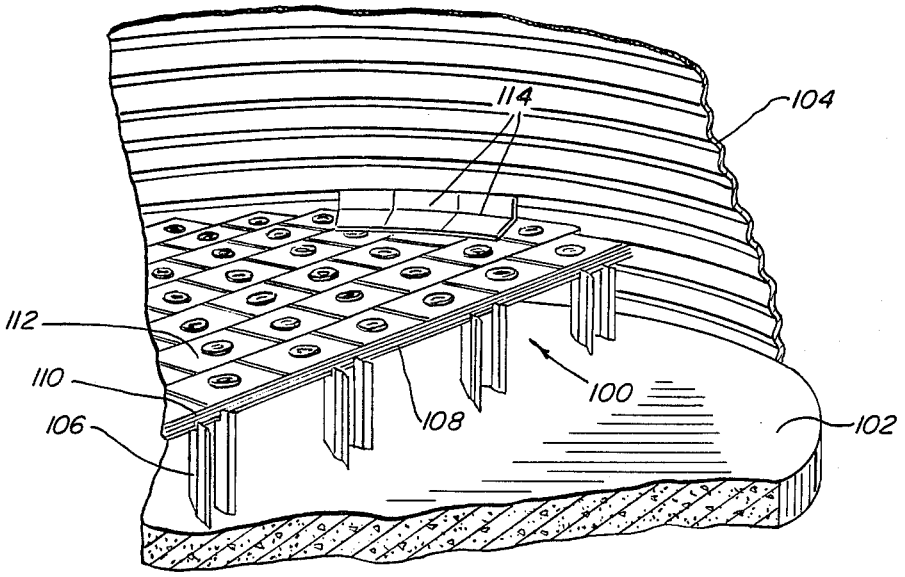
FIG. 2
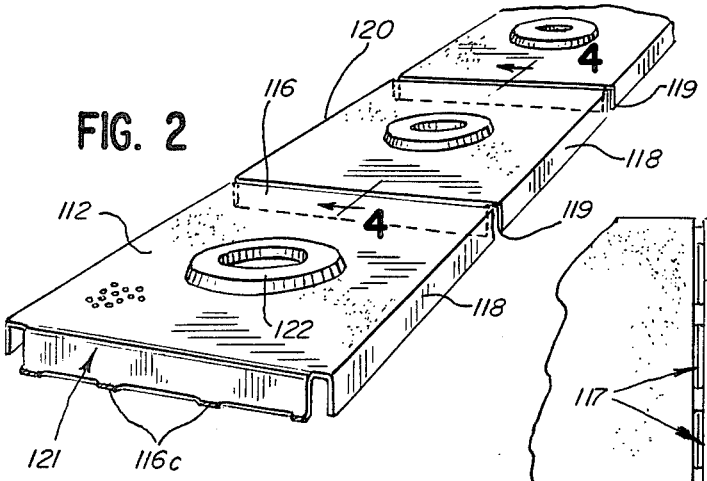
FIG. 3
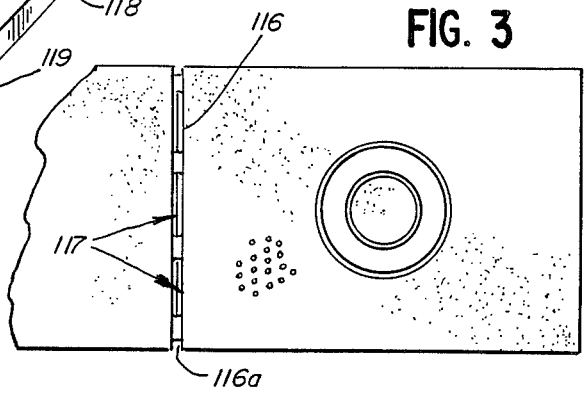
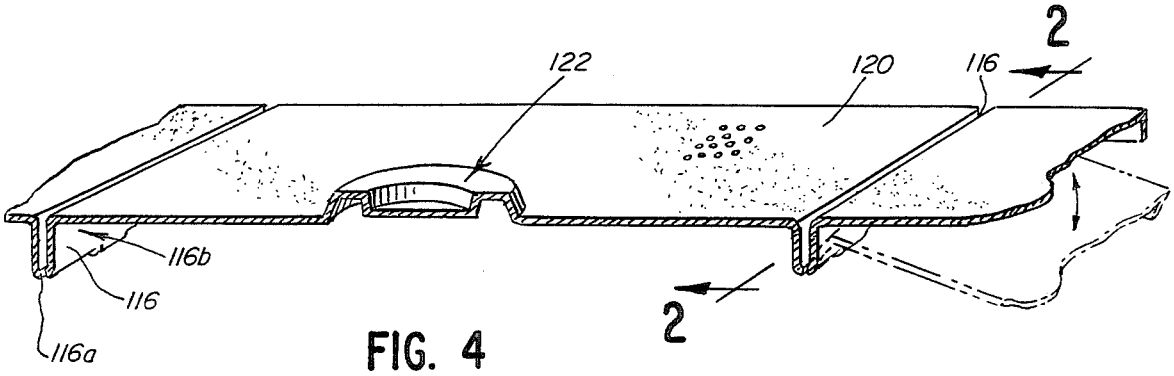
FIG. 4

FIG. 7
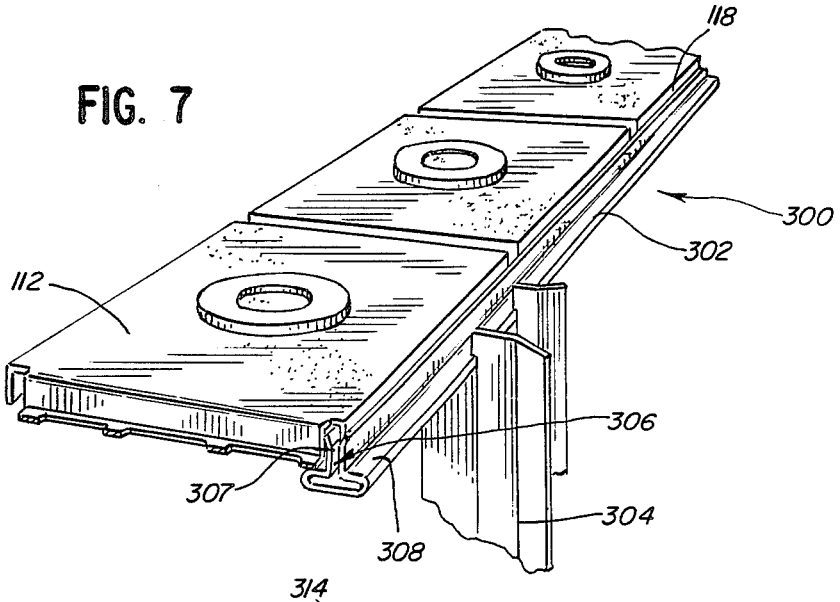
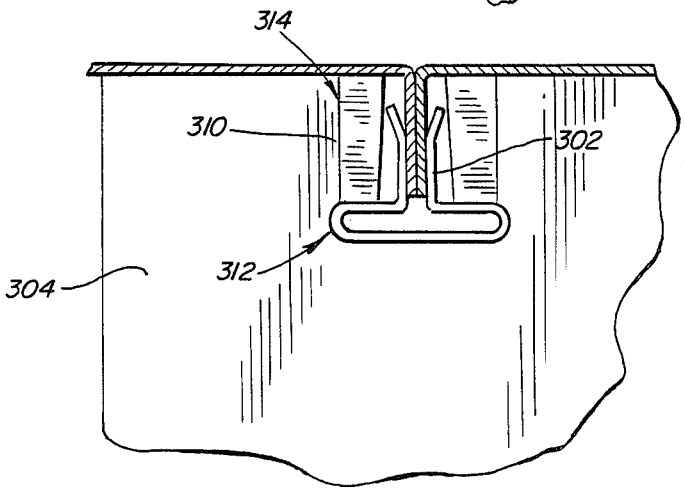
FIG. 8
FIG. 9
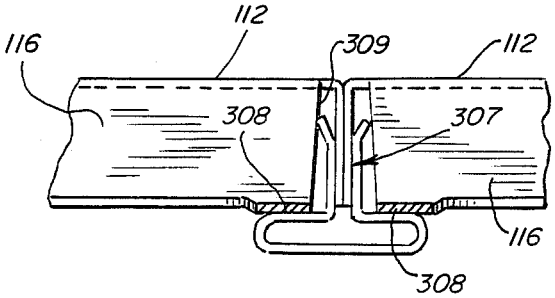

FIG. 10
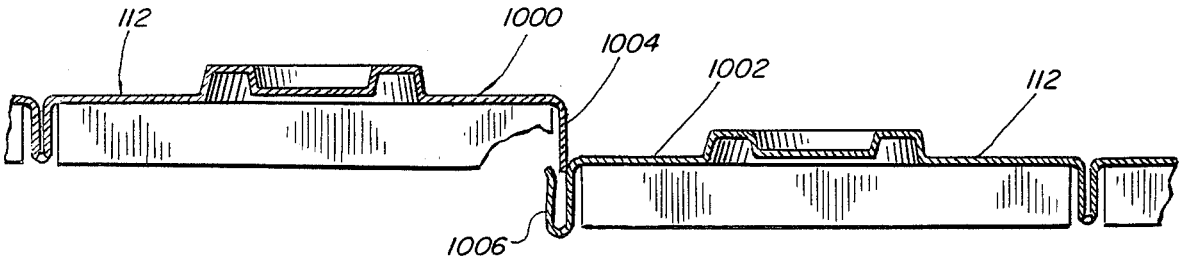
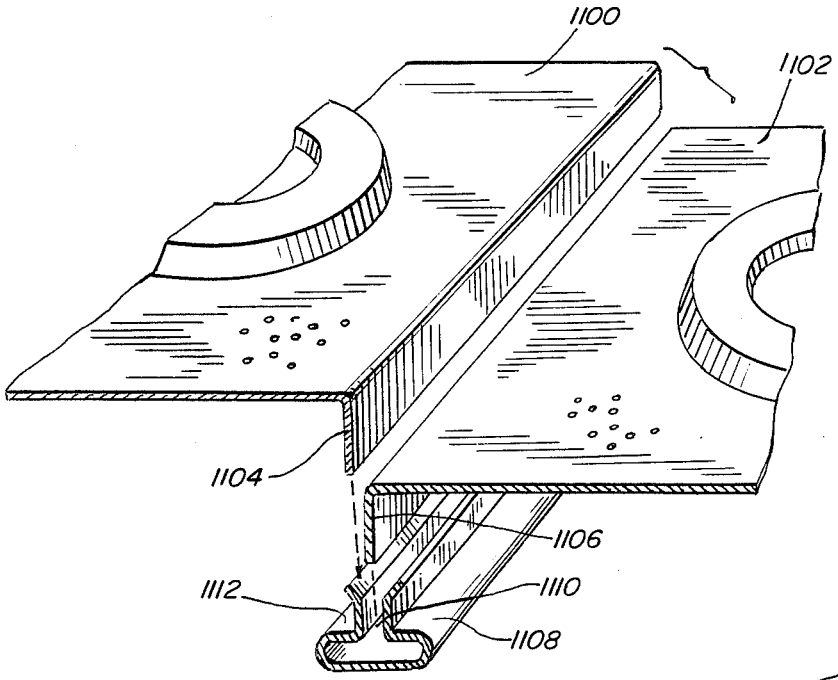
FIG. 11
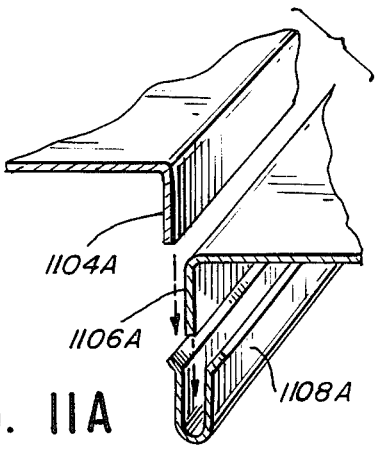
FIG. 11A

MODULAR FLOOR PANEL SYSTEM

This is a continuation-in part of copending application Ser. No. 471,860 filed Mar. 3, 1983 now U.S. Pat. No. 4,557,086 issued on Dec. 10, 1985

BACKGROUND OF THE INVENTION

Field of the Invention

This invention relates to floor panel systems for use in grain storage and drying bins. The flooring systems are comprised of modular perforated floor panels each of which is hemmed across the width of the panel at predetermined points along its length. Side flanges of the panels can be fit into slotted beams and a series of posts grip the beams and support the floor. The resulting floor system supports a load of grain or the like and provides a plenum chamber below the floor so that drying air may be forced therethrough.

Various flooring systems have been designed to support grain in a storage and drying bin. It is generally necessary to force heated air through the grain to dry the grain and prevent it from spoiling. As a result, a plenum is provided at the bottom of the bin to facilitate the entrance of air. The air is then forced through perforations in a false floor which forms the top of the plenum and provides a base for the grain.

The false floors typically used in such systems are comprised of lengths of steel channels or planks which can be joined along their longitudinal edges. The edges may be joined directly in interlocking arrangement or the edges may be joined by intermediary beams or rails. The steel channels extend across the bin from wall to wall. The bins very often are round, thereby requiring circular floors. Grain can also be stored in existing buildings which are rectangular or of varying shapes and sizes. The steel planks for false floors are generally custom made at the manufacturing location to fit into, for example, a round bin. These planks are of varying lengths and for a large diameter bin, some of the planks are substantially long because they are substantially equal to the length of the diameter. Consequently, transporting and storing these long planks is difficult and the varying sizes of planks make on-site assembly of the floor complicated and time consuming. In addition, due to the large variation of plank lengths, mistakes can arise during assembly of the floor, e.g., having a four foot portion of the bin and only a six foot piece remaining, thereby making it necessary to cut a plank to a particular length to complete assembly.

It is highly desirable to provide false floor systems which are easy to assemble and install while providing adequate support for the floor. Moreover, it is desirable to provide false floor planks or panels which are uniform in design and length and which can be severed readily into various lengths, e.g. for easy fitting and assembly into floors within round bins. It is also desirable to provide false floor planks or panels that can be utilized economically by minimizing the amount of flooring material required during the construction and fabrication of the floor support system.

OBJECTS OF THE INVENTION

It is an object of this invention to provide improved floor panels meeting the abovestated requirements.

It is an object of this invention to provide a modular floor panel for use in grain bins, and particularly to provide such panels which will satisfy the aforementioned requirements and meet the particular needs for grain storage.

It is another object of this invention to provide modular floor panels which are designed to facilitate assembly of grain bin floor systems in grain bins of varying shapes and sizes.

It is yet a further object of this invention to provide modular floor panels which can be easily severed into varying lengths and used in conjunction with a support system so that the grain bin floor will remain stable while the bin is empty and the floor is subjected to varying stresses or vibrations.

Further and additional objects of this invention will appear from the following description, accompanying drawings and appended claims.

SUMMARY OF THE INVENTION

In accordance with a preferred embodiment of this invention, the above requirements and objects are satisfied through a modular floor support system that uses modular floor panels which are perforated and employ transverse hems at regular spacings along each panel so that panels of various lengths can be provided readily by breaking standard panels along any appropriate selected hem. Each modular floor panel may have a complete hem at one end and a half hem or flange at the other end such that the panels can be readily aligned and interlocked end to end by inserting the half hem or flange of one panel into the full hem of a succeeding panel. A transverse clip may be used to hold together two abutted modular floor panels end to end where one of the abutting ends is not a full hem e.g., two half hems or flanges. The same or similar clips also may be placed over the full hems for reinforcing purposes where high floor loads are contemplated, e.g., in deep bins and/or with internal stirring systems. Lips or flanges extend along the sides of the panels except at the hems where there is a gap in each flange. Adjacent panels are abutted together along their sides and are held together by fitting the side lips or flanges into rails or support beams. The rails or beams in turn are resiliently gripped in notches cut into the top edges of the side walls of V-shaped posts. These notches in each post are aligned and are of a width such that the respective rail or support beam can be gripped and accommodated in a binding fit in the two notches in the general manner described in the aforementioned application Ser. No. 471,860 and U.S. Pat. No. 4,557,086. The projected width of the notches, i.e., as measured normal to a line passing through both notches, is less than the width of a support beam to be engaged therein, while the actual width of each notch is greater than the width of the channel. The beam can then be fit into and resiliently held by the legs of the post, as when the post is squeezed and then released.

DESCRIPTION OF THE DRAWINGS

For a more complete understanding of this invention, reference should now be made to the embodiments illustrated in greater detail in the accompanying drawings and described below by way of examples of the invention.

FIG. 1 is a partial perspective view of a modular false floor support system in a round bin and embodying teachings of this invention.

FIG. 2 is a top perspective view of a portion of a modular floor panel broken along line 2—2 of FIG. 4.

FIG. 3 is a bottom view of a portion of a modular floor panel of FIG. 1.

FIG. 4 is a section view through line 4—4 of FIG. 2 with phantom lines showing a modular floor panel being severed at its hem, and with the center embossment exaggerated in depth.

FIG. 7 is a partial perspective view of the preferred modular floor system using an inverted T-rail.

FIG. 8 is a section through the support post of a modular floor system as in FIG. 7 showing the post supporting the rail.

FIG. 9 is a section through the hem of a modular floor system as in FIG. 7, showing a rail which supports adjacent hems.

FIG. 10 is an exploded side view of two modular floor panels which can be interlocked end to end showing a half hem at one end of a modular floor panel and the full hem at the other end of a modular floor panel.

FIG. 11 is an exploded perspective view of the half hem flanges or machined severed hems of two modular floor panels being attached with the use of a transverse clip having an inverted T configuration.

FIG. 11A is an exploded perspective view of an alternative configuration of a transverse clip.

Figure 5:
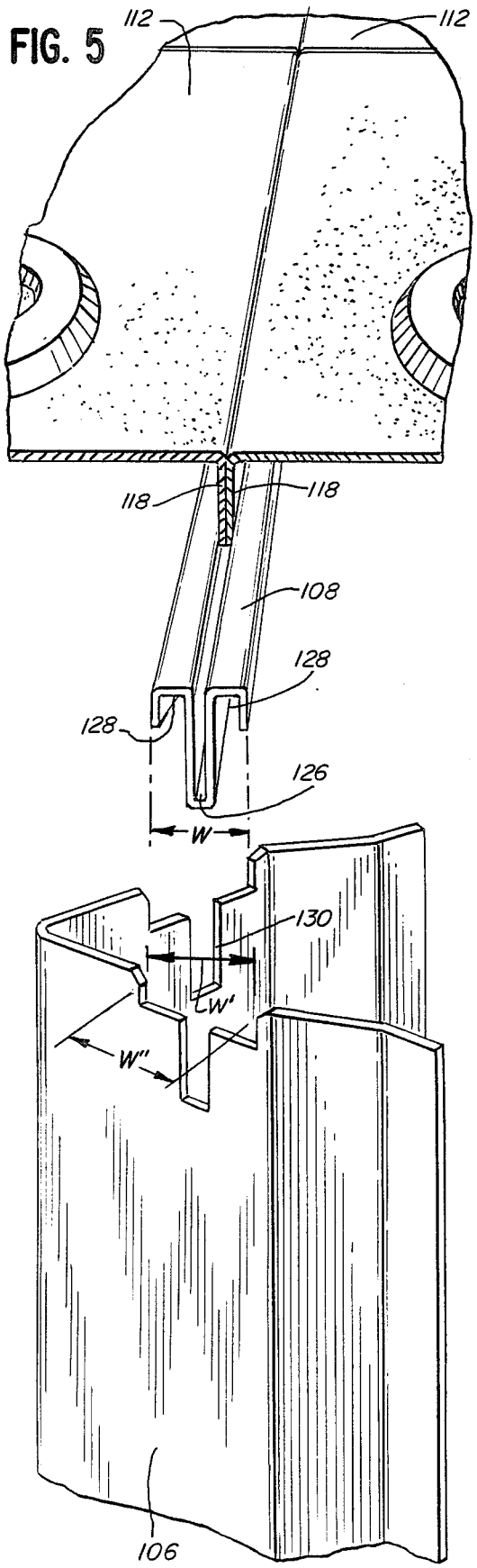
FIG. 5 is a partial exploded perspective view of a modular floor support system showing portions of the notched post, support beams and modular floor panel.

It should be understood that the drawings are not necessarily to scale and that an embodiment is sometimes illustrated in part by phantom lines and fragmentary views. In certain instances, details of the actual structure which are not necessary for an understanding of the present invention may have been omitted. It should be understood, of course, that the invention is not necessarily limited to the particular embodiments illustrated herein.

DETAILED DESCRIPTION

Turning first to FIG. 1, there is illustrated a perforated modular floor system 100 supported on the base 102 of a grain bin 104, within the bin. The bin 104 may be of conventional round bin construction fabricated of corrugated steel panels. Alternatively, such floor systems may be used in other buildings of varying shapes and sizes, such as are used to store grain or the like. An air supply system (not shown), such as a fan with or without an auxiliary heat source, typically is provided to force air into the plenum between the false floor 100 and base 102. This air is forced to flow upward through the perforate floor and through the grain supported on floor 100 for drying and conditioning purposes. The modular floor support system 100 is comprised of multiple independent notched floor supports or posts 106 gripping the bottom portion of support beams or rails 108 which accomodate the abutting edges 110 of hemmed modular floor panels or planks 112. Several pieces of floor to wall flashing 114 are shown in place on top of the ends of the assembled panels 112 to close the floor-to-wall gaps. The posts 106 and rails 108 and their general manner of assembly with one another in a floor system 100 as well as the flashing 114 and the grain bin 104 are presented to illustrate a preferred embodiment for the modular floor panels of the invention.

Referring to FIGS. 2–4 and 10, each modular plank 112 is formed of sheet metal, e.g., steel, and employs a plurality of transverse hems 116 (shown by phantom lines in FIG. 2) at unitary spacings along the plank. One end, sometimes referred to herein as the "front" end, of each unbroken plank 112 has a half hem or flange and the opposite or "back" end of each plank has a full hem so that the adjacent ends of aligned modular floor panels 112 may be interlocked (see FIG. 10). The transverse hems 116 are located between the ends of a modular floor panel and include means for facilitating severance of the panels into predetermined lengths. Each hem is formed as an integral depending U-shaped reverse bend defining a distal bight portion **116*a* and side portions or walls 116*b* which join the bight to the respective adjacent body portions of the plank. The distance between these side portions 116*b* is exaggerated in these drawings for illustrative purposes, but in practice the side portions 116*b* are contiguous to one another at the top to close the hem against entry of grain into the hem. Planks or panels of various lengths can be provided readily by breaking standard panels along an appropriate selected hem or hems 116. A line of spaced scores or slits 117 preferably is provided along the bight 116*a*, extending over the length of the hem, that is, the width of the panel, to facilitate such severance. A severed hem 121 is shown in FIG. 2 illustrating one of the side portions 116*b* and a plurality of tongues 116*c* resulting from the splitting of the bight portions 116*a* when the panel is broken along a hem. The severed hems 121, transverse hems 116**, as well as the full hems and half hem flanges (illustrated in FIG. 10) all provide transverse support for the respective plank panel and prevent the flooring from sagging at the center of the modular plank.

Lips or flanges 118 extend along the side edges of the modular panels 112 except at each hem 116 where there is a gap in each flange 118, as at 119 in FIG. 2. Generally, the depth of the hems 116 and flanges 118 are equal and are about ¾ inch. The width of the modular panels is typically about twelve inches and the hems 116 may be spaced about every twelve inches. A standard panel or plank 112 is about ten feet long, and thus is of a long narrow rectangular configuration. Each segment between adjacent hems 116 or between a hem and an end of the panel 112 forms a module 120. In the center of each module 120 is an embossed annulus 122, shown of exaggerated depth in the drawings for illustrative purposes. This annulus 122 is formed by stamping the surface of the module 120 and causing the annular portion of the module to be raised above the remaining portion of the module. This annulus 122 creates increased planar tension over the area of each module 120 and provides additional stability of the panel.

FIG. 3 shows a plan view of the bottom of the modular floor panel 112 and the annulus 122 which is indented from the bottom side of the panel. A hem 116 is shown which has a plurality of cuts or slits 117 in it along the bight portion of **116*a* of the hem. The hems 116 are of slightly less length than the panel width and thus are inset slightly at their ends from the sides of the modular plank 112**.

In FIG. 4, phantom lines show the first module 120 being separated from a modular panel 112. This separating or severing can be effected by repeatedly bending the module 120 at the bight of a hem 116 in a down and up movement. This movement weakens the hem 116 until the steel breaks and the module 120 can be separated from the remaining panel 112. The remaining portion of the panel 112 is illustrated in FIG. 2 which also shows the severed hem 121. Alternately. the hem 116 can be cut with an appropriate cutting tool to effectuate the separation. The slits 117 facilitate and ease the bending and severing which occurs along the segments between the slits, i.e., corresponding to the resulting tongues 116c projecting from the severed hem 121.

FIG. 5 shows a partial exploded view of the modular floor system 100 in FIG. 1. The modular floor panels 112 are abutted along the side flanges 118. The abutting flanges are placed in the central trough portion 126 of the support rail 108. The rail 108 defines two outer channels 128 and the central trough 126. The depth of the trough 126 is greater than the depth of the outer channels 128. The notches 130 of the post or floor support 106 are designed to accomodate the rail or beam 108 and are located in the upper portion of the sides of the post 106. These notches 130 are aligned with one another and will resiliently grip the rail 108. The actual width of the notches 130 is such that the two outer channels 128 and the central trough 126 of the rail 108 can be force fit into the notches 130 and resiliently gripped by the notch edges. To this end, it will be observed that each notch 130 has an actual width w″ measured along the divergent sides of the post 106 and a projected width w′ as measured normal to a center line passing through both notches. The actual width w″ is greater than the width w of the rail 108 between the outer channels but the projected width w′ is slightly less than the width w of the rail 108 and substantially less than the actual width w″ of the notches. When the sides of the post 106 are resiliently flexed toward one another, as by squeezing, the rail 108 can be fit into the notch 130 of the post 106. When the sides are released the rail 108 is resiliently gripped by the post 106.

The floor system 100 of FIG. 5 may be assembled by placing a rail or beam 108, in inverted position on a saw horse or other suitable support and attaching a predetermined number of posts 106 along its length by their resilient gripping engagement thereon. The post and beam assembly is then turned over so that the posts support the rail 108. The rail rests on the posts at the bottom of the notches. A series of these post and rail assemblies can be placed in parallel relation to one another and at a spacing corresponding to the width of the modular floor panels 112. The abutting flanges 118 of the contiguous modular floor panels 112 can be placed in the central trough 126 whereby the panels are supported by the post and rail assemblies and are held together by the rails. The inset ends of the hems accommodate this engagement of the panels in the rail beams.

Figure 6:
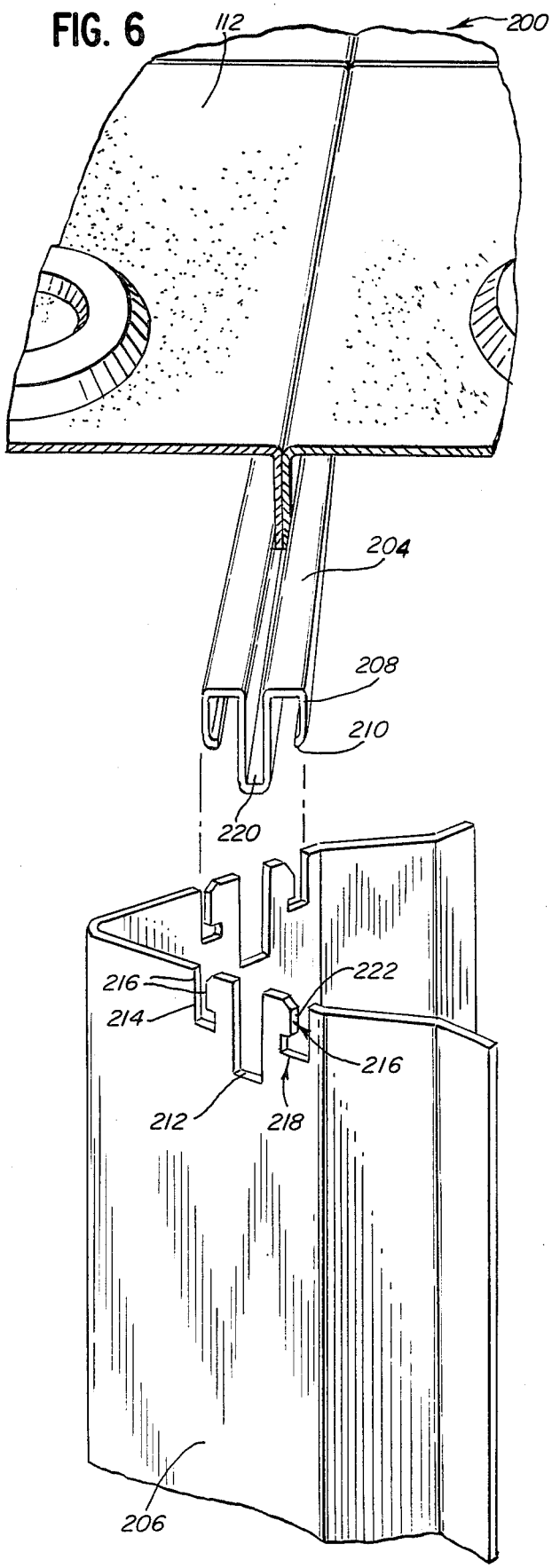
FIG. 6 is a partial exploded view of another embodiment of a false floor support system using support posts with L-shaped notches to provide additional gripping of the rails.

FIG. 6 shows a partial exploded view of a floor system 200 similar to that of FIG. 5 and with an additional interlocking feature. The floor system 200 comprises the modular floor panels 112 of this invention and rails 204 gripped by the floor support posts 206 where each rail 204 has two L-shaped outer flange edges 208 in addition to a central trough portion 220. Each L-shaped outer edge has an inwardly extending tab 210. Each post 206 has a central notch 212 in the top edge of each side and two outer L-shaped notches 214 having vertical legs 216 and inwardly extending lower portions 218. The notches in the post 206 accommodate the central trough 220 and the outer edges 208 of the rail 204. The spacing between the tabs 210 of a rail 204 is slightly less than the spacing between the inner vertical edges 222 of notch portions 216. Thereby the flanges are flexed outward slightly during assembly and provide snap engagement of the tabs 210 in slot portions 218 when the rail and post are fully seated, in addition to the gripping of the sides of the notches on rail 204. Thus, this design provides additional support to the rail 204 and provides a locking action of the rail 204 to the posts 206 by accommodating the tabs 210 of the rail.

FIGS. 7 through 9 show views of the preferred floor support system 300 to be used with the modular floor panels 112 of this invention. FIG. 7 is a partial perspective view of the modular floor support system 300 and shows the side flange 118 of a section of a modular floor panel 112 in place with a rail 302. The rail 302 is supported and gripped by posts 304. The center embossment of the floor panel modules are shown in exaggerated relief. FIG. 8 is a section across a rail and floor panels where a post 304 supports a rail 302. FIG. 9 shows a sectional view across the floor support system 300 at the hems 116 of two abutting modular panels 112. The rail 302 is an elongated member generally similar to the rails in FIGS. 5 and 6, but of a preferred cross section. It is of an inverted T-shape comprising a central open vertical trough 306 with a throat 307 located at the entry of the trough 306 and laterally extending ledges 308 at its bottom portion. As seen in FIG. 9, these ledges 308 support the ends 309 of each of the transverse hems 116 which are located at unitary spacings along the length of each modular panel 112. FIG. 9 also shows that the ends 309 of the hems 116 are tapered such that the hems 116 of abutting modular panels 112 are closer at the top than at the bottom where the hems 116 are supported by the ledges 308. This taper enables the flanges 118 of the modular panels 112 to be easily inserted into the trough 306 of the rail 302 without interference from the transverse hems 116. In addition, the tapered hems of abutting modular panels 112 provide a locking action which holds the sides of the throat 307 of the trough 306 together and prevents the abutting modular panels 112 from being separated or dislodged. The side flanges 118 extend along the sides of the panel 112 except at each hem 116 where there is a break or space between the flanges 118 of adjacent panel modules. FIGS. 8 and 9 show the flanges 118 of two modular panels 112 abutting each other and fit into the central trough 306 of the rail 302, as occurs along the entire length of the rail 302 except at each hem 116 where there is the break in the flanges 118 as previously noted.

The support post 304 as shown in FIGS. 7 and 8 is of the same general cross section as the other posts described above and has notches 310 cut into the top diverging edges of the post sides. Each notch 310 has a lower gripping portion 312 and an entry or throat portion 314. The actual width of the entry portion 314 is narrower than the actual width of the lower portion 312 but is greater than the width of the bottom portion of the rail 302 where the rail ledges 308 are located. The projected width of the entry portion 314 as measured normal to a center line passing through both notches 310 is less than the width of the bottom portion of the rail where the ledges 308 are located but is sufficiently wide that when the sides of the post 304 are resiliently squeezed, the bottom portion with the laterally extending rail ledges 308 can be accommodated by the entry portion 314 of the notch. When the rail is placed in the lower gripping portion 312 of the notch 310 and the sides of the post 304 are released, the bottom portion of the rail 302 is resiliently gripped in the lower portion 312 of the notch 310. In addition, since the entry portion 314 of the notch 310 is narrower in projected width, the rail 302 is locked into place by the resulting shoulders and prevented from being dislodged from the post 304.

The planks of this invention may be aligned and joined end to end to form runs of planks which extend across the bin from wall to wall. FIGS. 10 and 11 illustrate the attachment of aligned and successive modular floor panels which are part of a run of panels. In particular, FIG. 10 shows sections of first and second floor planks 1000, 1002 which have been aligned and are part of a run of planks. The hem 1004 of the first plank 1000 is in the form of a half hem flange, or a severed hem flange where its tongues have been ground away. The second plank 1002 has a full hem 1006 so that when the two planks 1000, 1002 are aligned at their respective ends, the half hem flange 1004 of the first plank 1000 is inserted into the full hem 1006 of the second plank 1002. This results in an interlock of the two planks 1000, 1002.

FIG. 11 shows first and second modular planks 1100, 1102 which are abutted at their end hem flanges 1104, 1106. A transverse clip 1108 is used to attach these hems 1104, 1106 together. One or both of these hems 1104, 1106 can be in the form of severed hems as shown in FIG. 2 where the tongues 116*c* have been ground away to enable the side portions 116*b* to be abutted. Alternatively, one or both of these hems 1104, 1106 can be in the form of a simple flange. Also, one of these hems could be in the form of a ground severed hem and the other in the form of a half hem flange. Any of these combinations can arise during the assembly of the false floor in a bin where a full hem is not available to provide the aforedescribed interlock for successive planks of a run. Such a situation can arise where the number of modules with severed or half hems which must be attached to a successive plank is greater than the number of full hems available for attachment. For example, the paneling may be formed as a continuous strip of indeterminate length and then severed at the bights of appropriate hems as the strip is formed or subsequently, to form panels of standard lengths, for convenient shipment and handling, e.g., 10' long. Under such circumstances the transverse clip 1108 holds these end flanges 1104, 1106 together.

The transverse clip 1108 has a similar configuration as the rail 302 in FIGS. 7–9 i.e., an inverted T-shape with a throat 1110 and ledges 1112. The transverse clip 1108 extends across the width of the plank, between the side support rails, and each end of the clip may rest on a separate support post. Alternatively, FIG. 11A shows a simple U-shaped transverse clip 1108A of slightly less depth that may be used with each end of the clip resting on the respective adjacent ledge of a corresponding rail (not shown). In either event, the flanges 1104, 1106 of FIG. 11 or 1103A, 1106A of FIG. 11A are fit into the throat of the clip and are held together in a similar manner as are the side flanges of adjacent floor panels.

Transverse clips may be used at every transverse hem in grain bins where the effective floor loading makes such reinforcement desirable, e.g., where the grain is greater than a specified depth, such as thirty feet.

The modular floor panels of this invention are particularly economical and easy to assemble in round storage bins which require circular floors or in other bins such as a rectangular building. In round bins, the required length of each run or series of aligned floor planks varies with its position in the bin. Through the center of the bin, the length of the floor plank run is substantially equal to the diameter of the bin. The various runs at each side of the centrally positioned run, however, are of lengths progressively less than the diameter of the bin and substantially equal to a cord at the respective location and parallel to the diameter of the bin. Thus where the diameter or particular cord of a bin is not a multiple of the standard length of a floor panel, the modular floor panels of the present invention are particularly useful. The ability of each modular floor panel to be easily severed or separated at the bight of any hem permits readily satisfying the varying length requirements for runs of panels or individual panels and facilitates efficient floor construction. In addition, the modules are readily adaptable to grain bins of any shape and variations of the grain bin size can be accommodated.

Thus a modular floor plan system and manner of assembly have been provided which meet the aforestated objects of this invention.

While certain embodiments of the invention have been shown, it will be understood, of course, that the invention is not limited thereto since modifications may be made and other embodiments of the principles of this invention will occur to those skilled in the art to which this invention pertains, particularly upon considering the foregoing teachings. It is, therefore, contemplated by the appended claims to cover any such modifications and other embodiments as incorporate those features which constitute the essential features of this invention within the true spirit and scope of the following claims.

What is claimed is:

1. A modular grain bin floor comprising in combination:

(a) a plurality of elongated modular grain bin floor panels each having opposite side edges and opposite ends, each of said panels formed of bendable sheet metal and including a plurality of modules each located between said side edges, said modules of each panel being disposed in end-to-end relation to one another and forming a substantially continuous upper surface extending the length of said panel between said opposite ends, a reverse-bend hem of said sheet metal extending transversely of the respective panel between and integrally joining each adjacent pair of said modules to one another, each of said hems extending downwardly relative to said upper surface and providing transverse support for said panel, and each of said hems providing means for facilitating severance of said modules whereby at least one of said modules can be separated from the respective modular floor panel along such hem for forming panels of selected lengths, said panels being disposed in coplanar relationship with one another and with said side edges of adjacent panels adjacent to one another;

(b) a support beam extending subjacent each said pair of adjacent panel side edges; and (c) a plurality of support posts for each of said beams, each of said posts straddling the respective beam and being in generally vertical alignment therewith.

2. A modular floor panel combination as in claim 1 wherein each such integral transverse hem is scored thereacross for readily separating at least one of said modules from said floor panel.

3. A modular floor panel combination as in claim 1 wherein said means at each of said hems for facilitating severance of said modules comprises a bight portion with a plurality of slits arranged in substantially linear spaced relationship with each other and extending the length of said integral transverse hem, and two side walls in substantially parallel relationship extending vertically subjacent to said modules and integral with the respective bight.

4. A modular floor panel combination as in claim 3 wherein each such transverse hem is inset from each respective side edge whereby the length of said hem is less than the width of the respective floor panel.

5. A modular floor panel combination as in claims 1, 2, 3 or 4 wherein each of said support beams comprises a vertical trough including two opposite sides and two ledges extending laterally from opposite sides of the trough whereby the side edges of two adjacent panels are received in said trough and a portion of each of said hems of each said panel engages the respective adjacent ledges of said support beams.

6. A modular floor panel combination as in claim 1 wherein each of said modules has an embossment integral with said module.

7. A modular floor panel combination as in claim 1 having first and second modular floor panels wherein each of said modular floor panels has a U-shaped hem at one end and a flange at the opposite end and wherein said flange of said first panel is inserted into said U-shaped hem of said second panel.

8. A modular floor panel combination as in claim 1 or 7 including first and second modular floor panels, a transverse clip having a trough therein, each of said panels having a flange at one end, and said flange of said first panel abutting said flange of said second panel and said flanges being inserted into said trough for joining said panels.

9. A modular floor combination as in claim 1 including at least one transverse clip having a trough wherein said transverse hem is inserted into said trough and an end of said transverse clip is held by said beam.

10. The modular floor panel combination as in claim 1, 2, 3, 4, 6, 7 or 9 wherein each of said support beams is a separate element from the respective panels and supports the respective side edges thereover.

11. The modular floor panel combination as in claim 10 wherein each of said support beams is an integral member and of a length to span a plurality of said modules of a panel.

12. An elongated modular grain bin floor panel formed of an integral piece of bendable sheet metal and comprising opposite side edges, two opposite ends, a plurality of modules of said sheet metal arranged end-to-end in a series from one of said ends of said panel to the other and forming a substantially continuous upper surface of said panel from one of said ends to the other, a transverse hem of said sheet metal extending downwardly relative to said upper surface and integrally joining each adjacent pair of said modules and providing transverse support for said panels, and each of said hems providing means for facilitating severance of said modules, whereby at least one of said modules can be separated from said modular floor panel along one of said hems.

13. An elongated modular sheet metal bin floor panel as in claim 12 wherein said means at each of said hems for facilitating severance of said modules comprises a bight portion with a plurality of slits arranged in substantially linear spaced relationship with each other and extending along the length of the respective integral transverse hem, a two side walls extending from said bight and integral with the respective module.

14. The invention as in claim 1 or 12 wherein each of said modular floor panels has a U-shaped hem at one end and a flange at the other end for engaging with a U-shaped hem of another panel.

15. In a grain storage bin comprising a plurality of contiguous elongated floor panels and means for supporting said elongated panels above a base, the improvement which comprises each of said elongated panels being formed of an integral piece of bendable sheet metal and including a plurality of modules disposed in end-to-end relation to one another and forming a substantially continuous upper surface extending the length of said panel, a transverse hem of said sheet metal joining each adjacent pair of said modules, each of said hems extending transversely of the respective panel and downwardly relative to said upper surface to provide transverse support for said panel and including means for facilitating severance of selected modules from said elongated panel and comprising a bight portion and two side walls extending from said bight and integral with the panel portion on the respective side of said hem whereby each of said elongated floor panels can be readily severed at any such hem.

16. The improvement as in claim 15 wherein each of said bight portions is found with a plurality of slits in substantially linear relationship with each other and extending along the length of the respective hem.

17. A method of forming a floor in a grain storage bin comprising providing elongated floor panels formed of bendable sheet metal, each having a substantially continuous upper surface and transverse hems extending transversely of the respective panel and downwardly relative to said upper surface to provide transverse support for said panel and each of said hems providing means for facilitating severance of said panels at modular spacings, and severing said panels into desired lengths by bending and breaking at selected hems.

* * * * *

UNITED STATES PATENT AND TRADEMARK OFFICE

CERTIFICATE OF CORRECTION

PATENT NO. : 4,709,519

DATED : December 1, 1987

INVENTOR(S) : Allen C. Liefer

It is certified that error appears in the above-identified patent and that said Letters Patent is hereby corrected as shown below:

In item "[76]" on the cover page delete Gilbert L. Loewen and Paul J. Magathan as inventors; In item "[56]" on the cover page, correct the classification of the Steffen Pat. 3,426,445 to read --52/192--; Col. 3, line 26, after "a" insert --succeeding--; and Col. 10, 1. 13, "a" should read --and--.

Signed and Sealed this

Sixth Day of December, 1988

*Attest:*

*Attesting Officer*

DONALD J. QUIGG

*Commissioner of Patents and Trademarks*